US008266764B2

(12) United States Patent
Costabel et al.

(10) Patent No.: US 8,266,764 B2
(45) Date of Patent: Sep. 18, 2012

(54) HINGE FOR A PACKAGING BOX OR THE LIKE

(75) Inventors: Sascha Costabel, Otisheim (DE); Olav Schendel, Stuttgart (DE)

(73) Assignee: SFS intec Holding AG, Heerbrugg (CH)

( * ) Notice: Subject to any disclaimer, the term of this patent is extended or adjusted under 35 U.S.C. 154(b) by 197 days.

(21) Appl. No.: 12/674,046

(22) PCT Filed: Sep. 30, 2008

(86) PCT No.: PCT/EP2008/063059

§ 371 (c)(1),
(2), (4) Date: Feb. 18, 2010

(87) PCT Pub. No.: WO2009/050032

PCT Pub. Date: Apr. 23, 2009

(65) Prior Publication Data

US 2011/0185536 A1 Aug. 4, 2011

(30) Foreign Application Priority Data

Oct. 16, 2007 (DE) ..... 20 2007 014 471 U

(51) Int. Cl.
*E05F 3/20* (2006.01)

(52) U.S. Cl. ..... 16/54; 16/50; 16/308; 188/290

(58) Field of Classification Search ..... 16/321, 16/297, 308, 386–387, 54, 50, 75, DIG. 10, 16/2.1, 303, 82, 85, DIG. 17, DIG. 21; 188/290, 188/296, 322.5; 4/246.1, 248
See application file for complete search history.

(56) References Cited

U.S. PATENT DOCUMENTS

| | | | | | |
|---|---|---|---|---|---|
| 3,903,567 | A | * | 9/1975 | Suska | 16/301 |
| 4,117,567 | A | * | 10/1978 | Shimizu | 16/50 |
| 4,485,522 | A | | 12/1984 | Chen | |
| 4,829,628 | A | * | 5/1989 | Vuksic | 16/54 |
| 5,222,260 | A | * | 6/1993 | Piper | 4/246.1 |
| 5,572,768 | A | | 11/1996 | Daul | |

(Continued)

FOREIGN PATENT DOCUMENTS

| | | |
|---|---|---|
| DE | 29808910 | 8/1998 |

(Continued)

*Primary Examiner* — William L. Miller
(74) *Attorney, Agent, or Firm* — Volpe and Koenig, P.C.

(57) ABSTRACT

A hinge for a packaging or cargo box or the like, having a first and a second hinge leaf, the second hinge leaf has a first bushing and a second bushing located at a distance therefrom, between which a bushing of the first hinge leaf can be rotated about a mutual hinge axis. An axial tube is rotationally fixed to the bushing of the first hinge leaf and is pivot-supported in the bushings of the second hinge leaf. A torsion spring is disposed in the axial tube and attached to one end of the axial tube. A torque support connects the other end of the torsion spring to the second hinge leaf in a rotationally fixed manner. A damper for the hinge movement is connected to the second hinge leaf and the axial tube. In a cylindrical hollow space of an outer opening, formed by the three bushings (65*a*, 65*b*, 65*c*), the damper (56), the axial tube (53) containing the torsion spring (58), and the torque support (54*a*) are inserted successively starting at the second bushing (65*b*) of the second hinge leaf (52), and the torque support (54*a*) is prevented from rotating and from being axially displaced in the second bushing (65*b*) by a safety device (54*d*, 68*a*, 70, 72).

7 Claims, 2 Drawing Sheets

U.S. PATENT DOCUMENTS

| | | | | |
|---|---|---|---|---|
| 5,715,574 | A * | 2/1998 | Schall | 16/301 |
| 6,182,301 | B1 * | 2/2001 | Krueger et al. | 4/248 |
| 6,634,061 | B1 | 10/2003 | Maynard | |
| 6,789,292 | B2 | 9/2004 | Oshima et al. | |
| 2002/0078529 | A1 | 6/2002 | Schwarz | |

FOREIGN PATENT DOCUMENTS

| | | |
|---|---|---|
| DE | 20308234 | 8/2003 |
| DE | 60207518 | 8/2006 |
| WO | 0061903 | 10/2000 |

* cited by examiner

HINGE FOR A PACKAGING BOX OR THE LIKE

BACKGROUND

The invention relates to a hinge for a packaging or cargo box or the like.

The outer configuration of such a hinge is known from the publication DE 203 08 234 U1, in particular, from FIGS. 3 and 9. The principle inner configuration of such a hinge is known from the publication DE 298 08 910 U1 that is involved with, in particular, the configuration of a damper for the hinge motion. The inner configuration of a hinge of the type noted above is shown in FIGS. 5-8 accompanying this document and will now be discussed in more detail.

Such a hinge that is designated overall with 10 has a first hinge leaf 11 and a smaller second hinge leaf 12. The latter can be inserted into a holder 20. The holder 20 is not of further interest here. It is shown and described in detail in the publication DE 203 08 234 U1 mentioned above. The second hinge leaf 12 has a first bearing bushing 15*a* and a second bearing bushing 15*b* between which a bearing bushing 15*c* of the first hinge leaf 11 can rotate about a common hinge axis 22. An axle tube 13 can be locked in rotation with the bearing bushing 15*c* of the first hinge leaf 11, in the shown case by not-shown external teeth on the periphery of the axle tube 13 that engages with a positive fit in internal teeth of the bearing bushing 15*c*. In the bearing bushings 15*a* and 15*b* of the second hinge leaf 12, the axle tube 13 can be supported so that it can rotate. A torsion spring 18 is locked in rotation with the first bearing bushing 15*a* of the second hinge leaf 12 by a disk-shaped torque converter support 14*a* and a cylinder pin 14*b*. The torsion spring 18 is arranged in the axle tube 13 and attached with one end to the axle tube. According to the diagram in FIG. 7, the axle tube 13 is closed on its upper end and the bent end of the torsion spring 18 arranged therein is connected to the axle tube 13 by a cylinder pin 14*c*. The torque converter support 14*a* and the cylinder pin 14*b* lock the other end of the torsion spring 18 in rotation to the second hinge leaf 12, as is similarly shown in FIG. 7. A damper designated overall with 16 for the hinge motion that has, in principle, the configuration known from the publication DE 298 08 910 U1 noted above is connected to the second hinge leaf 12 and the axle tube 13. The damper 16 has a damping vane that can rotate in a chamber of a damper housing 16*a* filled with viscous damping material and that has, on its axially outer end, two catch pins 16*b* that engage in corresponding recesses in the adjacent end of the axle tube 13. A sleeve 17 for holding the damper 16 by an adhesive epoxy resin 19 is mounted on the second bearing bushing 15*b* of the second hinge leaf 12. The sleeve 17 has a polygonal construction on the inside in cross section, in order to be able to lock the damper housing 16*a* in rotation, wherein this damper housing has a similar polygonal construction on the outside. When the damper 16 is inserted into the sleeve 17, the sleeve 17 is closed at the end with a cover 24. The cover 24 is mounted on the sleeve 17 similarly with the help of the adhesive epoxy resin 19. The damper housing 16*a* is likewise mounted in the sleeve 17 with the help of the adhesive epoxy resin 19. The damping vane, which is the moving part of the damper 16, rotates with the axle tube 13, when the two hinge leaves 11, 12 are moved relative to each other. Before the cylinder pin 14*b* is inserted, the torsion spring 18 is biased by turning the torque converter support 14*a*. The desired biasing state is then fixed by inserting the cylinder pin 14*b*. Setting and fixing the biasing state is not simple, because the positions of the torque converter support 14*a* in which the cylinder pin 14 can be inserted into the corresponding passage borehole in the torque converter support 14*a*, lie at least 180° apart from each other. Because the spring constants of the springs used as torsion springs 18 can have relatively large tolerances, it is often a tedious process until the correct biasing state is set, after which rotational steps of only a half revolution are available.

When the cover (not shown) of a cargo box is closed, wherein this cover is mounted on the first hinge leaf 11, the hinge leaf 11 is moved by the movement of the cover from the position shown with dash-dot lines in FIG. 8 into the position shown in FIG. 8 with solid lines. The biased torsion spring 18 is here further biased so that its torsion force acts in the opening direction of the hinge 10, that is, in the direction of the position shown with dash-dot lines in FIG. 8. This configuration simplifies the opening of the cover of a cargo box. When the cover is unlocked, the cover is moved into the position shown with dash-dot lines in FIG. 8 by the biased torsion spring, with the tension in the torsion spring 18 being increasingly reduced.

When such hinges are used for cargo boxes in airplanes, the hinge weight is a very important criterion. The assembly costs of such a hinge, however, are criteria that are no less important for this or any other application. The weight of the hinge is in direct relationship to the number of its individual parts. The assembly costs are similarly based on the number of individual parts to be assembled and also on whether the assembly is simple or complicated. With respect to both criteria, the known hinge described above appears to need improvements. The known hinge must be made freely accessible from two sides for the assembly in the hinge axis. This limits not only the installation possibilities of the hinge, but also makes the assembly complicated and also increases the number of parts that are absolutely required. The production of adhesive connections makes at least one additional processing step necessary.

In this way, in the case of the assembly, not only is the setting of the correct biasing of the torsion spring 18 difficult, but the mounting of the sleeve 17 is also difficult. The damper 16 is bonded in the sleeve 17. The sleeve 17 must be brought into a suitable position beforehand, so that the catch pins 16*b* can also be inserted in the correct position in corresponding catch openings in the end face of the axle tube 13. Therefore, the assembly is typically performed so that the sleeve 17 is set on the second bearing bushing 15*b* and a dummy is inserted into the sleeve instead of the damper 16. When the sleeve 17 and the dummy have the correct position, the sleeve 17 is bonded with the second bearing bushing 15*b*. Then the dummy is removed again and replaced by the damper 16 that is now inserted in the correct position in the sleeve 17 and can be fixed therein. Only then can the cover 24 be bonded.

The assembly can be made more difficult in that the boreholes in the bearing bushings 15*a* and 15*b* are not round. The hinge 10 is typically made from a fiberglass-containing plastic and is made through injection molding. Injection-molded parts made from plastic, however, tend to contract on one side, which expresses itself in that the boreholes of the bearing bushings 15*a* and 15*b* are not round, but are, instead, oval. If this is discovered during assembly, then the bearing boreholes of the bearing bushings 15*a* and 15*b* are preferably refinished.

SUMMARY

The objective of the invention is to improve the construction of a hinge of the type noted above so that it is made from fewer individual parts and can be assembled more easily.

This objective is met in the case of a hinge of the type noted above with the features of the invention.

Because, in the case of the hinge according to the invention, the damper, the axle tube containing the torsion spring, and the torque converter support are inserted one after the other in a cylindrical hollow space formed by the three bearing bushings together from an outer opening of the second bearing bushing and the torque converter support is blocked from turning and shifting in the axial direction in the second bearing bushing by a securing device, the assembly is already simpler, because all of the individual parts noted above are inserted in the sequence indicated above from one and the same side of the hinge into the bearing bushings and the securing against rotation and axial displacement is realized on the same side. This has the additional advantage that the other side of the hinge in the axial direction does not need to be accessible. The hinge according to the invention also requires fewer individual parts, because the torque converter support on the insertion side of the axle tube is attached on the hinge and thus also offers additional possibilities for simplifying the rotation locking. The hinge according to the invention further requires no sleeve bonded on the second bearing bushing of the second hinge leaf for holding the damper, because this is held by the second bearing bushing. Thus, not only is the cover eliminated that is required in the known hinge for closing the sleeve, but the tedious setting of the damper is also eliminated, because this is inserted first and the other elements are then adapted to the position of the damper. The necessary spring biasing is then set only at the completion of the assembly process, wherein the position of the damper in the first bearing bushing 65*a* of the second hinge leaf is automatically taken into account.

Advantageous configurations of the invention form the subject matter of the subordinate claims.

In one construction of the hinge according to the invention, if the securing device includes a securing element that engages via at least one opening in the second bearing bushing in a peripheral groove of a retaining ring that is locked in rotation with the torque converter support, then the entirety of the hinge elements held in the cylindrical hollow space formed by the three bearing bushings together can be secured against axial displacement with a single securing element.

In another construction of the hinge according to the invention, if the securing device is a spring clip that engages via two openings in the second bearing bushing in the peripheral groove of the retaining ring, then the securing can be produced more easily by hand than with a cylindrical pin, because the spring clip can be inserted into the peripheral groove in any rotational position of the retaining ring.

In another construction of the hinge according to the invention, for the rotational locking between the torque converter support and the retaining ring, if the torque converter support has a cylinder peg with external teeth, wherein this peg engages in an opening of the retaining ring with internal teeth, and the retaining ring has an outer periphery with external teeth that engage in internal teeth in the second bearing bushing of the second hinge leaf, then the necessary biasing can be set on the assembly formed from the axle tube and the torsion spring in a simpler way and the assembly can then be locked against rotation. The setting of the required biasing can be performed in an especially simple and especially very precise way, because the retaining ring can be pushed onto the peg in any rotational position of the cylinder peg 54*d*. The relative mismatched position between these elements can equal, namely, at most one tooth width, while the corresponding step in the known hinge equals at least one half revolution or 180°.

In another construction of the hinge according to the invention, if the first and the second bearing bushing project past the second hinge leaf approximately equally as far in the axial direction, then a symmetric configuration of the hinge is produced, without a sleeve having to be bonded onto one of the bearing bushings.

In another construction of the hinge according to the invention, if the first bearing bushing of the second hinge leaf is closed on its side facing away from the second bearing bushing, then the second hinge leaf can be completely produced in one injection-molding process, without an additional cover having to be bonded onto one of the bearing bushings at a later time.

In another construction of the hinge according to the invention, if the damper has a radial damping vane that can rotate in a chamber of a damper housing filled with viscous damping material, wherein the damper housing is connected with a positive fit to the first bearing bushing of the second hinge leaf, then the hinge movement can be damped in a simple manner.

BRIEF DESCRIPTION OF THE DRAWINGS

An embodiment of the invention will be described in more detail below with reference to the drawings. Shown are.

DETAILED DESCRIPTION OF THE PREFERRED EMBODIMENTS

The known hinge shown in FIGS. 5-8 has already been explained above. The following description is therefore limited to the embodiment of a hinge according to the invention shown in FIGS. 1-4. Identical or similar parts of the hinge according to the invention are here provided with reference numbers increased by 40 with respect to the reference numbers of the corresponding parts of the known hinge.

Figure 1:
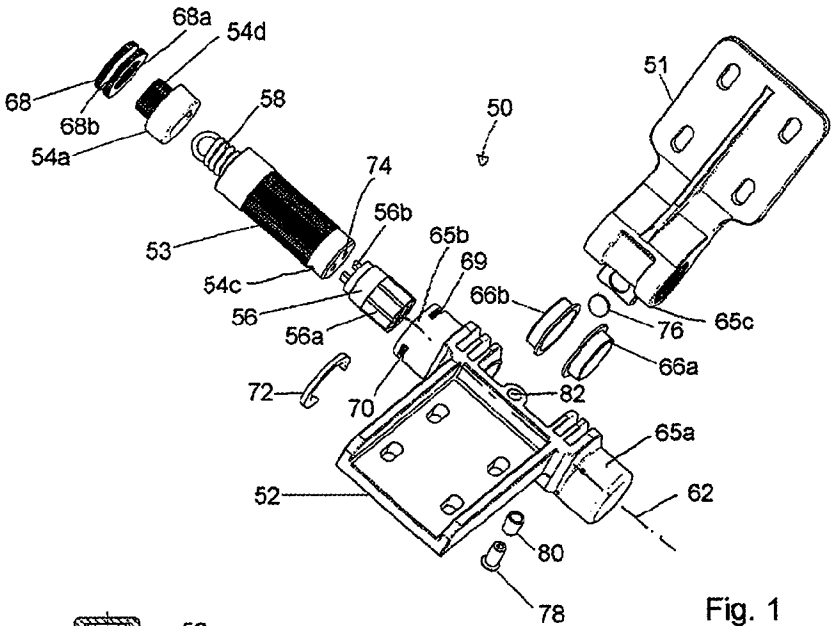
FIG. 1 an exploded, perspective view of an embodiment of a hinge according to the invention, FIG. 2 a bottom view of the hinge shown in FIG. 1 according to the invention, FIG. 3 a section view taken along line III-III in FIG. 2 of the hinge according to the invention, FIG. 4 a side view of the hinge according to the invention in which the hinge is shown with projection lines in a position in which, when the hinge is inserted in a cargo box, its cover is closed, FIG. 5 an exploded, perspective view of a known hinge, FIG. 6 a top view of the hinge according to FIG. 5, FIG. 7 a section view of the hinge taken along line VII-VII in FIG. 6, and FIG. 8 a side view similar to FIG. 4 showing the known hinge, wherein, however, the closed position is shown with dash-dot lines.

FIG. 1 shows an embodiment of a hinge designated as a whole with 50 in an exploded, perspective diagram. The hinge 50 has a first hinge leaf 51 and a second hinge leaf 52. The second hinge leaf 52 has a first bearing bushing 65*a* and a second bearing bushing 65*b* set apart from the first bearing bushing. Between the bearing bushings 65*a*, 65*b*, a bearing bushing 65*c* of the first hinge leaf 51 can rotate about a common hinge axis 62. An axle tube 53 is locked in rotation with the bearing bushing 65*c* of the first hinge leaf 51 and is mounted so that it can rotate in the bearing bushings 65*a* and 65*b* of the second hinge leaf 52. The rotational locking is produced through the engagement of external teeth of the axle tube 53 in internal teeth of the bearing bushing 65*c*. The axle tube 53 is supported in the bearing bushings 65*a*, 65*b* in bearing bushings 66*a* or 66*b*, respectively. When finally worn, the bearing bushings 66*a*, 66*b* can be easily replaced. The bearing bushings 66*a*, 66*b* are made from POM, a plastic with good bearing properties. This guarantees smooth running and noise minimization. In addition, the one-sided contraction that is typical in injection-molded parts is equalized. The bearing bushings 66*a*, 66*b* guarantee that the bearing boreholes of the bearing bushings 15*a*, 15*b* that hold the axle tube 13 so that it can rotate are lined to be completely round.

A torsion spring 58 is arranged in the axle tube 53 and mounted with one end (not visible in FIG. 1) in the axle tube. For mounting the torsion spring end, the axle tube 53 has a closed end with a central recess into which extends the enclosed end of the torsion spring 58 and through which a cylinder pin 54*c* is guided, as is shown in FIG. 1 in an outer view and in FIG. 3 in a section view along the line III-III in FIG. 2. The other end of the torsion spring 58 is locked in rotation with the second hinge leaf 52 by a torque converter support 54*a*. On an opposite side in the axial direction, the axle tube 53 is connected by a catch 56*b* to the moving part of a damper 56 for the hinge motion. The stationary part of the damper 56, a damper housing 56*a*, has a polygonal construction in cross section and is inserted into the borehole of the first bearing bushing 65*a*, wherein this borehole has a corresponding polygonal cross section, and is thus locked in rotation therein, without requiring an adhesive connection.

As a securing device against rotation and axial displacement of the axle tube 53 that is inserted in a cylindrical hollow space formed by the three bearing bushings 65*a*-65*c* together, a retaining ring 68 is allocated to the torque converter support 54*a*. For a rotationally locked connection between the torque converter support 54*a* and the retaining ring 68, a cylinder peg 54*d* is formed on the torque converter support, wherein this peg has external teeth and engages in an opening 68*a* of the retaining ring 68 with internal teeth, and the retaining ring 68 has an outer periphery 68*b* that has external teeth and that engages in internal teeth 69 in the second bearing bushing 65*b* of the second hinge leaf 52.

Figure 3:
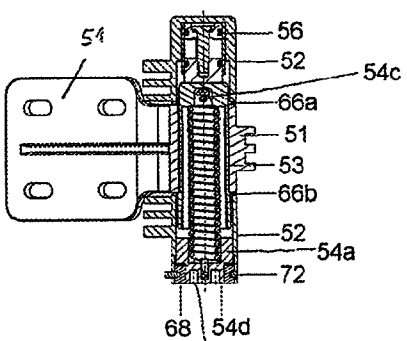
Figure 2:
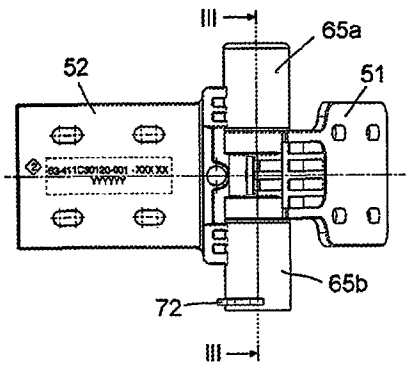
Figure 5:
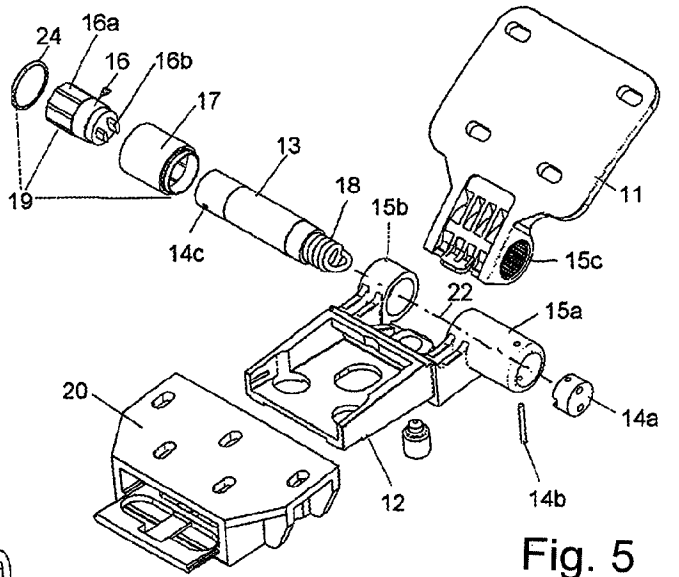
Fig. 5 (Prior art)
Figure 7:
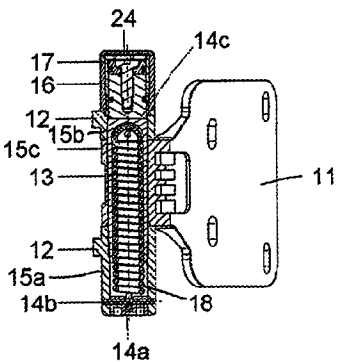
Fig. 7 (Prior art)

The first and the second bearing bushing 65*a*, 65*b* project past the second hinge leaf 52 approximately equally as far in the axial direction, as is to be seen in FIG. 1, and are dimensioned so that, between and within themselves, they completely house the elements of the hinge 50 shown in FIG. 1 at the left of the second bearing bushing 65*b*, as is shown in FIG. 3 in the section along the line III-III in FIG. 2. The assembly procedure of the hinge is described in even more detail farther below.

The first bearing bushing 65*a* of the second hinge leaf 52 is closed on its side facing away from the second bearing bushing 65*b*, as is to be seen in FIG. 1. This is easily achieved in that the first bearing bushing 65*a* is formed as a pot-shaped structure on the second hinge leaf 52, while the second bearing bushing 65*b* of the second hinge leaf 52 is formed as a sleeve that is open on both ends on the second hinge leaf 52, that is, axially flush with the first bearing bushing 65*a*. The hinge leaves 51, 52 are produced in the shown embodiment of the hinge 50 according to the invention as injection-molded parts made from plastic.

The damper 56 has the same construction as the known damper 16 and has accordingly a radial damping vane that can rotate via the catch pins 56*b* and that can rotate in a chamber of the damper housing 56*a* filled with viscous damping material, wherein the damper housing is connected to the first bearing bushing 65*a* of the second hinge leaf 52 with a positive fit, as already explained above.

The already mentioned securing device that prevents rotation and axial displacement of the axle tube 53 that is inserted into the cylindrical hollow space formed by the three bearing bushings 65*a*-65*c* together comprises, as a securing element, a spring clip 72 that engages via two openings 70 in the second bearing bushing 65*b* in a peripheral groove 68*b* of the retaining ring 68.

For assembling the hinge 50, the two bearing bushings 66*a*, 66*b* are inserted into the first or second bearing bushing 65*a*, 65*b*, so that they assume the position shown in FIG. 3. Then the first hinge leaf 51 is inserted with its bearing bushing 65*c* between the bearing bushings 66*a*, 66*b*, so that it is concentric to the hinge axis 62. Beforehand or subsequently, the damper 56 is inserted into the first bearing bushing 65*a* until it makes contact on its inner end, as shown in FIG. 3. The assembly consisting of the axle tube 53 and the torsion spring 58 mounted therein is inserted from an outer opening of the second bearing bushing 65*b* of the second hinge leaf 52 into the hollow space formed by the three bearing bushings 65*a*-65*c* together, until two openings 74 at the end of the axle tube have received the catch pins 56*b* of the damper 56. As soon as the axle tube 53 has been inserted completely into the cylindrical hollow space, the torque converter support 54 is inserted into the second bearing bushing 65*b* and in this way pushed onto the end of the torsion spring 58 projecting from the axle tube 53. In the cylinder peg 54*d* formed on the torque converter support 54*a*, a recess is contained that receives the enclosed end of the torsion spring 58, as is to be seen in FIG. 3. The cylinder peg 54*d* has two catch openings 74 in its outer end face. In the catch openings 74, two corresponding catch pins of a turning tool (not shown) are inserted. With the turning tool, the torsion spring 58 is turned until a desired biasing is produced. Then, while maintaining the biasing, the retaining ring 68 is pushed onto the cylinder peg and in this way inserted with its external teeth into the internal teeth 69 of the second bearing bushing 65*b*, through which a rotationally locked connection is produced between the torque converter support 54*a* and the second bearing bushing 65*b*. For axial locking, the spring clip 72 is inserted with both ends into the openings 70 of the second bearing bushing 65*b*.

Figure 4:
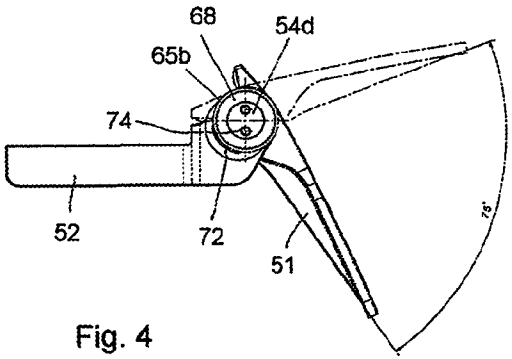
Figure 8:
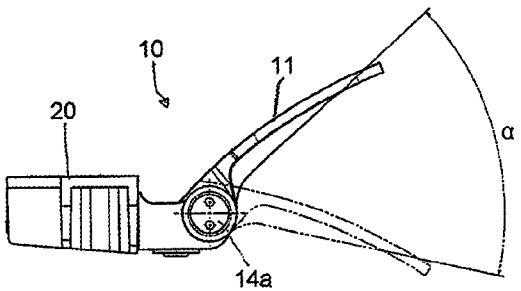
Fig. 8 (Prior art)
Figure 6:
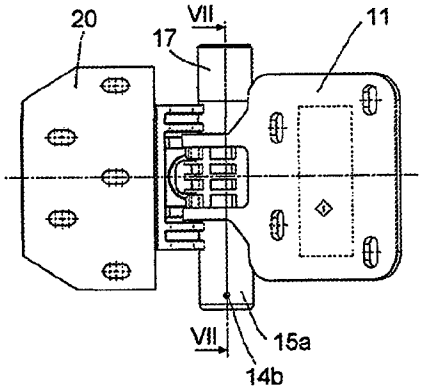
Fig. 6 (Prior art)

Through the spring biasing, a stop bumper 76 (FIG. 1) on the first hinge leaf 51 is pressed against the head of a threaded pin 78 that is mounted with a helicoil 80 in a borehole 82 in the second hinge leaf 52. The first hinge leaf 51 then assumes, relative to the second hinge leaf 52, a spring-biased position that is shown in FIG. 4 with dash-dot lines. The first hinge leaf 51 in FIG. 4 can be deflected by an angle of 75°, against the force of the biasing of the torsion spring 58, into a position shown with broken lines, in which the not-shown cover of a cargo box with which the hinge 50 is equipped is in a closed position. The torsion force of the torsion spring 58 of the hinge 50 increased further by the closing of the cover thus acts in the direction of opening of the cover. The angle of 75° is greater than a corresponding angle $\alpha$ in the known hinge 10 (FIG. 8).

The assembly of the hinge 50 that is described above is very simple, because all that is required is to insert the elements shown in FIG. 1 at the left of the second hinge leaf 52 in the previously described way into the cylindrical hollow space of the hinge formed by the bearing bushings 65*a*-65*c* together, to bias the torsion springs 58 as explained, and then to introduce the retaining ring 68 with external teeth into the second bearing bushing 65*b* with internal teeth, and to secure them by the spring clip 72. In addition, the hinge 50 has a simpler construction than the hinge 10, because the sleeve 17 and the cover 24 of the known hinge are not needed and thus also the processing steps are eliminated that are required for producing connections with adhesive epoxy resin in the known hinge.

LIST OF REFERENCE SYMBOLS

10 Hinge
11 First hinge leaf
12 Second hinge leaf
13 Axle tube
14*a* Torque converter support
14*b* Cylinder pin
14*c* Cylinder pin
15*a* First bearing bushing
15*b* Second bearing bushing
15*c* Bearing bushing
16 Damper
16*a* Damper housing
16*b* Catch pin
17 Sleeve
18 Torsion spring
19 Adhesive epoxy resin
20 Holder
22 Hinge axis
24 Cover
51 First hinge leaf
52 Second hinge leaf
53 Axle tube
54*a* Torque converter support
54*c* Cylinder pin
54*d* Cylinder peg
56*a* Damper housing
56*b* Catch pin
65*a* First bearing bushing
65*b* Second bearing bushing
65*c* Bearing bushing
66*a* Bearing bushing
66*b* Bearing bushing
68 Retaining ring
68*a* Opening with internal teeth
68*b* Outer periphery with external teeth
69 Internal teeth
70 Opening
72 Spring clip
74 Catch opening
76 Stop bumper
78 Threaded pin
80 Helicoil
82 Borehole

The invention claimed is:

1. A hinge for a cargo box or other article, comprising:

a first and a second hinge leaf, the second hinge leaf has a first bearing bushing and a second bearing bushing set apart from the first bearing bushing, a bearing bushing of the first hinge leaf is rotatable about a common hinge axis between the first and second bearing bushings, an axle tube locked in rotation with the bearing bushing of the first hinge leaf and is supported in the bearing bushings of the second hinge leaf so that it rotates, a torsion spring arranged in the axle tube and mounted with one end on the axle tube, a torque converter support that locks the other end of the torsion spring in rotation with the second hinge leaf, and a damper for hinge motion connected to the second hinge leaf and the axle tube, a cylindrical hollow space is formed by the three bearing bushings (65*a*, 65*b*, 65*c*) together, wherein the damper (56) has smaller outside dimensions than inside dimensions of the second bearing bushing (65*b*) and the bearing bushing (65*c*) of the first hinge leaf (51) so that the damper (56) is slidable through the second bearing bushing (65*b*) and the bearing bushing (65*c*) of the first hinge leaf (51), and the damper (56), the axle tube (53) containing the torsion spring (58), and the torque converter support (54*a*) are inserted successively from an outer opening of the second bearing bushing (65*b*) of the second hinge leaf (52) into the cylindrical hollow space from a same side of the hinge so that an end of the first bearing bushing on an axially opposite side of the hinge can remain closed or inaccessible, and the torque converter support (54*a*) in the second bearing bushing (65*b*) is prevented from rotation and axial displacement by a securing device (54*d*, 68*a*, 70, 72).

2. The hinge according to claim 1, wherein the first and the second bearing bushing (65*a*, 65*b*) project approximately equally as far in an axial direction past the second hinge leaf (52).

3. The hinge according to claim 1, wherein the first bearing bushing (65*a*) of the second hinge leaf (52) is closed on a side facing away from the second bearing bushing (65*b*).

4. The hinge according to claim 1, wherein the damper (56) has a radial damping vane that rotates in a chamber of a damper housing (56*a*) filled with viscous damping material, and the damper housing is locked in rotation with the first bearing bushing (65*a*) of the second hinge leaf (52).

5. A hinge for a cargo box or other article, comprising:

a first and a second hinge leaf, the second hinge leaf has a first bearing bushing and a second bearing bushing set apart from the first bearing bushing, a bearing bushing of the first hinge leaf is rotatable about a common hinge axis between the first and second bearing bushings, an axle tube locked in rotation with the bearing bushing of the first hinge leaf and is supported in the bearing bushings of the second hinge leaf so that it rotates, a torsion spring arranged in the axle tube and mounted with one end on the axle tube, a torque converter support (54*a*) that locks the other end (58) of the torsion spring in rotation with the second hinge leaf (52), and a damper for hinge motion connected to the second hinge leaf and the axle tube, a cylindrical hollow space is formed by the three bearing bushings (65*a*, 65*b*, 65*c*) together, wherein the damper (56), the axle tube (53) containing the torsion spring (58), and the torque converter support (54*a*) are inserted successively from an outer opening of the second bearing bushing (65*b*) of the second hinge leaf (52) into the cylindrical hollow space, and the torque converter support (54*a*) in the second bearing bushing (65*b*) is prevented from rotation and axial displacement by a securing device (54*d*, 68*a*, 70, 72), wherein the securing device comprises a securing element that engages through at least one opening (70) in the second bearing bushing (65*b*) in a peripheral groove (68*b*) of a retaining ring (68) that is locked in rotation with the torque converter support (54*a*).

6. The hinge according to claim 5, wherein the securing element comprises a spring clip (72) that engages via two openings (70) in the second bearing bushing (65*b*) in the peripheral groove of the retaining ring (68).

7. The hinge according to claim 5, wherein for the rotational locking between the torque converter support (54*a*) and the retaining ring (68), the torque converter support (54*a*) has a cylinder peg (54*d*) that has external teeth and that engages in an opening (68*a*) of the retaining ring (68) with internal teeth, and the retaining ring (68) has an outer periphery with external teeth that engage in internal teeth (69) in the second bearing bushing (65*b*) of the second hinge leaf (52).

* * * * *